US008915794B2

(12) United States Patent
Stites

(10) Patent No.: US 8,915,794 B2
(45) Date of Patent: Dec. 23, 2014

(54) GOLF CLUBS AND GOLF CLUB HEADS

(75) Inventor: John T. Stites, Weatherford, TX (US)

(73) Assignee: Nike, Inc., Beaverton, OR (US)

( * ) Notice: Subject to any disclaimer, the term of this patent is extended or adjusted under 35 U.S.C. 154(b) by 596 days.

(21) Appl. No.: 12/427,510

(22) Filed: Apr. 21, 2009

(65) Prior Publication Data

US 2010/0267463 A1 Oct. 21, 2010

(51) Int. Cl.
*A63B 53/00* (2006.01)
*A63B 55/00* (2006.01)
*A63B 53/04* (2006.01)

(52) U.S. Cl.
CPC ..... *A63B 53/047* (2013.01); *A63B 2053/0491* (2013.01); *A63B 2053/005* (2013.01); *A63B 2053/045* (2013.01)
USPC ..... 473/291; 473/350

(58) Field of Classification Search
USPC ..... 473/331, 349–350, 290–291
IPC ..... A63B 53/00
See application file for complete search history.

(56) References Cited

U.S. PATENT DOCUMENTS 2,087,685 A * 7/1937 Hackney ..... 473/349
2,859,972 A 11/1958 Reach
3,814,437 A * 6/1974 Winquist ..... 473/350
4,671,513 A 6/1987 Swanson
4,715,601 A 12/1987 Lamanna
4,802,672 A * 2/1989 Long ..... 473/291
4,809,977 A 3/1989 Doran et al.
4,883,274 A * 11/1989 Hsien ..... 473/335
4,907,806 A * 3/1990 Antonious ..... 473/242
4,915,386 A * 4/1990 Antonious ..... 473/350
4,919,430 A 4/1990 Antonious
4,923,197 A * 5/1990 Schacht ..... 473/291
5,014,993 A 5/1991 Antonious
D318,703 S * 7/1991 Shearer ..... D21/748
5,046,733 A 9/1991 Antonious
5,242,167 A * 9/1993 Antonious ..... 473/350
5,290,032 A 3/1994 Fenton et al.
5,295,686 A * 3/1994 Lundberg ..... 473/291
5,306,008 A 4/1994 Kinoshita
5,328,184 A 7/1994 Antonious
5,377,985 A * 1/1995 Ohnishi ..... 473/324
5,401,021 A 3/1995 Allen (Continued)

FOREIGN PATENT DOCUMENTS

JP 59-161852 10/1984
JP 08024373 A * 1/1996 ..... A63B 53/00

(Continued)

OTHER PUBLICATIONS

Aizawa, machine translation of JP08024373A, 6 pages.*

(Continued)

*Primary Examiner* — Gene Kim
*Assistant Examiner* — Matthew B Stanczak
(74) *Attorney, Agent, or Firm* — Banner & Witcoff, Ltd.

(57) ABSTRACT

Golf club heads which include an iron type golf club head body include a ball striking face, a rear surface opposite the ball striking face (e.g., including a perimeter weighting member) and a multi-legged bridge member which indicates the location of the center of gravity of the golf club head body. Golf clubs including these club heads and methods of making such golf club and golf club heads also are provided.

31 Claims, 6 Drawing Sheets

(56) References Cited

U.S. PATENT DOCUMENTS

| | | | | | |
|---|---|---|---|---|---|
| 5,447,307 | A * | 9/1995 | Antonious | 473/350 |
| 5,524,880 | A * | 6/1996 | Kobayashi | 473/291 |
| 5,549,297 | A | 8/1996 | Mahaffey | |
| 5,595,552 | A * | 1/1997 | Wright et al. | 473/332 |
| 5,643,099 | A | 7/1997 | Solheim | |
| D385,003 | S | 10/1997 | Burrows | |
| 5,695,411 | A * | 12/1997 | Wright et al. | 473/332 |
| 5,697,855 | A * | 12/1997 | Aizawa | 473/350 |
| D390,294 | S | 2/1998 | Burrows | |
| D390,295 | S | 2/1998 | Burrows | |
| 5,823,887 | A | 10/1998 | Mikame et al. | |
| D401,299 | S | 11/1998 | Burrows | |
| 5,851,159 | A | 12/1998 | Burrows | |
| 5,851,160 | A | 12/1998 | Rugge et al. | |
| 5,916,042 | A | 6/1999 | Reimers | |
| D413,642 | S | 9/1999 | Burrows | |
| D413,953 | S | 9/1999 | Burrows | |
| D418,887 | S * | 1/2000 | Williams, Jr. | D21/749 |
| 6,015,354 | A * | 1/2000 | Ahn et al. | 473/256 |
| 6,089,994 | A | 7/2000 | Sun | |
| 6,277,032 | B1 | 8/2001 | Smith | |
| 6,379,262 | B1 | 4/2002 | Boone | |
| 6,422,951 | B1 | 7/2002 | Burrows | |
| 6,454,665 | B2 | 9/2002 | Antonious | |
| 6,923,732 | B2 * | 8/2005 | Stites et al. | 473/291 |
| D512,757 | S * | 12/2005 | Cleveland et al. | D21/747 |
| 7,048,647 | B2 * | 5/2006 | Burrows | 473/334 |
| 7,201,669 | B2 * | 4/2007 | Stites et al. | 473/337 |
| 7,235,023 | B2 | 6/2007 | Sugimoto | |
| 7,704,155 | B2 | 4/2010 | Bennett et al. | |
| 7,744,487 | B2 | 6/2010 | Tavares et al. | |
| 2002/0082108 | A1 | 6/2002 | Peters et al. | |
| 2003/0199331 | A1 * | 10/2003 | Stites, III | 473/290 |
| 2004/0018890 | A1 | 1/2004 | Stites et al. | |
| 2004/0204263 | A1 | 10/2004 | Fagot et al. | |
| 2005/0137024 | A1 * | 6/2005 | Stites et al. | 473/291 |
| 2007/0099720 | A1 | 5/2007 | Gillig | |
| 2009/0118034 | A1 | 5/2009 | Yokota | |
| 2010/0267461 | A1 | 10/2010 | Stites | |

FOREIGN PATENT DOCUMENTS

| | | | | |
|---|---|---|---|---|
| JP | 10127832 A * | 5/1998 | | A63B 53/00 |
| JP | 2000126337 * | 5/2000 | | A63B 53/00 |
| JP | 2000229138 * | 8/2000 | | A63B 53/00 |
| JP | 2007-044087 | 2/2007 | | |
| JP | 2007-516047 | 6/2007 | | |

OTHER PUBLICATIONS

International Search Report and Written Opinion issued on Feb. 7, 2011 in corresponding PCT/US2010/050478.
International Search Report and Written Opinion dated Jul. 28, 2010 issued in corresponding PCT/US2010/030186.
International Preliminary Report on Patentability issued in International Application No. PCT/US2010/030186, mailed Nov. 3, 2011.
Office Action from U.S. Appl. No. 12/572,709 mailed Jun. 5, 2012.
ISR dated Aug. 3, 2010 from PCT Application PT/US2010/029310.
IPRP dated Oct. 4, 2012 from PCT Application PT/US2010/029310.
IPRP dated Apr. 3, 2012 from PCT Application PT/US2010/050478.
Office Action dated Jan. 26, 2012 from U.S. Appl. No. 12/572,709.
Office Action dated Apr. 3, 2012 from U.S. Appl. No. 13,099/016.
Office Action dated Feb. 22, 2013 from U.S. Appl. No. 12/572,709.
Non Final Office Action from U.S. Appl. No. 12/572,709 mailed Jun. 14, 2013.
English translation of JP Notice of Reasons for Rejection for JP Application No. 2012-507244.

* cited by examiner

GOLF CLUBS AND GOLF CLUB HEADS

FIELD OF THE DISCLOSURE

The present disclosure relates to golf clubs and golf club heads. Particular example aspects of this disclosure relate to golf clubs and golf club heads having indicators for indicating particular regions of the golf club head.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

While the industry has witnessed dramatic changes and improvements to golf equipment in recent years, there is room in the art for further advances in golf club technology.

SUMMARY OF THE DISCLOSURE

The following presents a general summary of aspects of the disclosure in order to provide a basic understanding of the disclosure and various aspects of it. This summary is not intended to limit the scope of the disclosure in any way, but it simply provides a general overview and context for the more detailed description that follows.

Golf club heads according to at least some example aspects of this disclosure include: an iron-type golf club head body having a ball striking face and a rear surface opposite the ball striking face (e.g., including a perimeter weighting member extending rearward from the ball striking face and along at least a portion of a circumferential area of the golf club head body). Also, the golf club head body may include an indicator. According to some aspects of this disclosure, the indicator may be a multi-legged bridge member. Further, in accordance with at least some examples of this disclosure, the multi-legged bridge member may indicate the precise location of the center of gravity of the golf club head.

A set of golf club heads in accordance with at least some examples of this disclosure may include club head bodies that have varying centers of gravity depending on the particular club head body. In such golf club head bodies, the multi-legged bridge members may be shaped differently to indicate the location of the center of gravity for each respective club head body.

According to some aspects of this disclosure, the differently shaped multi-legged bridge members can be used to alter the center of the gravity of the club head body. For example, due to the multi-legged bridge member's weighting characteristics (weight, density, etc.), the shape of the multi-legged bridge member will redistribute the weight of the golf club head body and thereby shift the club head body's center of gravity. Therefore, the multi-legged bridge member can be selectively shaped to control features of the club head's center of gravity.

Additional aspects of this disclosure relate to golf club structures that include golf club heads, e.g., of the types described above. Such golf club structures further may include one or more of: a shaft member attached to the club head (optionally via a separate hosel member or a hosel member provided as an integral part of one or more of the club head or shaft); a grip or handle member attached to the shaft member; additional weight members; etc.

Still additional aspects of this disclosure relate to methods for producing golf club heads and golf club structures, e.g., of the types described above. Such methods may include, for example: (a) providing a golf club head of the various types described above, e.g., by manufacturing or otherwise constructing the golf club head body, by obtaining the golf club head body from another source, etc.; and (b) engaging a shaft member with the golf club head. Other steps also may be included in these methods, such as engaging a grip member with the shaft member, club head body finishing steps, etc.

BRIEF DESCRIPTION OF THE DRAWINGS

The present disclosure is illustrated by way of example and not limited in the accompanying figures, in which like reference numerals indicate similar elements throughout, and in which.

Figure 1:
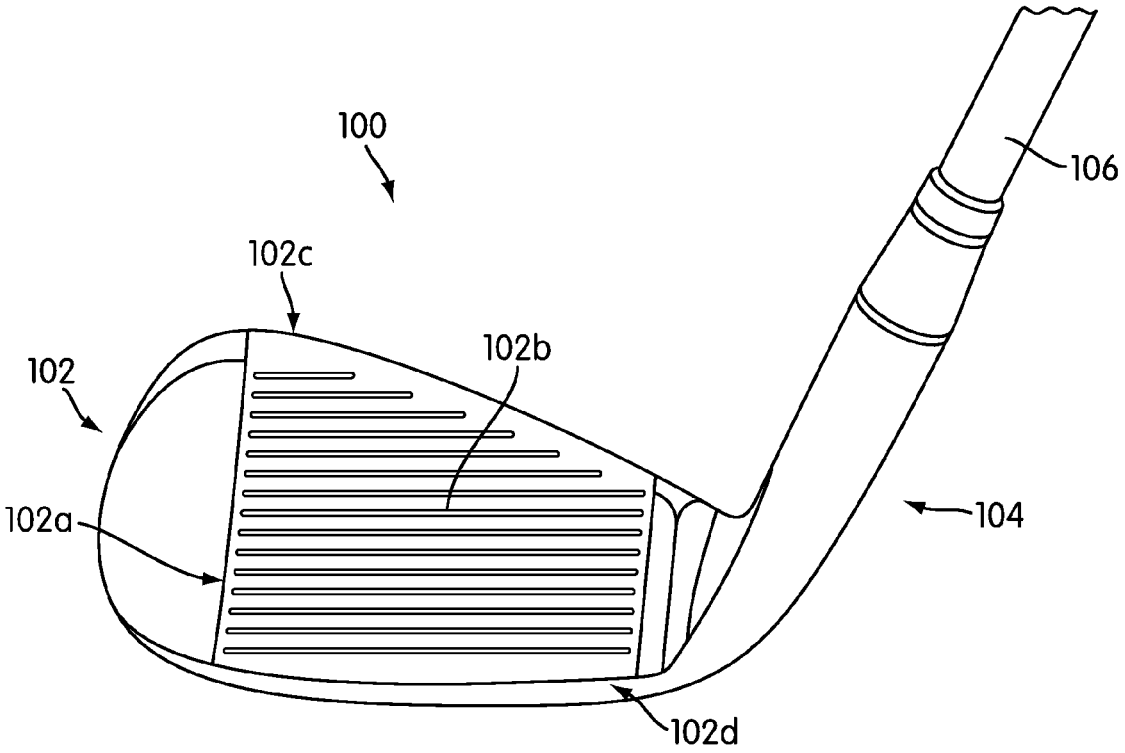
FIG. 1 generally illustrates features of a golf club structure according to at least some examples of this disclosure.

The reader is advised that the various parts shown in these drawings are not necessarily drawn to scale.

DETAILED DESCRIPTION

The following description and the accompanying figures disclose features of golf club heads and golf clubs in accordance with examples of the present disclosure.

I. General Description of Example Golf Club Heads, Golf Clubs, and Methods in Accordance with this Disclosure As described above, aspects of this disclosure relate to iron-type golf club heads and golf clubs. Iron-type golf club heads according to at least some example aspects of this disclosure may include: (a) an iron-type golf club head body; (b) a ball striking face; (c) a rear surface opposite the ball striking face, optionally including a perimeter weighting member extending rearward from the ball striking face and along at least a portion of a circumferential area of the golf club head body; and (d) a multi-legged bridge member which indicates a particular region of the golf club head body.

According to aspects of this disclosure, the multi-legged bridge member may indicate the location of the center of gravity of the golf club head body. Therefore, according to such aspects of this disclosure, in a set of golf clubs wherein each golf club head body has a different center of gravity, the multi-legged bridge member for each golf club head body may be different (e.g., differently shaped) in order to reflect the different location of the center of gravity of each particular golf club head body in the set. For example, because the center of gravity of a golf club head body for a pitching wedge may be different than the center of gravity of a golf club head body for a 5-iron, the multi-legged bridge member for the pitching wedge indicates a location which is different from the location indicated by the multi-legged bridge member on the 5-iron.

According to aspects of this disclosure, the multi-legged bridge member itself may affect the location of the center of gravity of the golf club head body. For example, the weight of the multi-legged bridge member may affect the location of the center of gravity of the golf club head body. Further, the multi-legged bridge members may have different weights, different densities, different weight distributions, and/or other different weighting characteristics relative to the rest of the club head body. Therefore, according to such aspects of this disclosure, the multi-legged bridge member may be shaped to alter the center of gravity of the club head body. In other words, the shape of the multi-legged bridge member can be controlled in order to provide a particular center of gravity for a golf club head body. As described below, providing a particular center of gravity for a golf club head body can be advantageous.

According to some aspects of this disclosure, the multi-legged bridge members in "long" iron type golf clubs (i.e., irons with a relatively low degree of loft, e.g., a 3-iron) may be shaped to provide a center of gravity of the golf club head body which is closer to the heel of the club head body (i.e., near the hosel). Such a configuration decreases the distance from the hosel to the center of gravity of the golf club head body. Because the center of gravity is closer to the hosel, the golfer can more quickly and easily rotate the golf club head body (e.g., from an open club face position to a closed club face position). Hence, such a configuration can aid a golfer in imparting "draw" trajectory to the golf ball. A "draw" is a golf shot in which the golfer curves the ball in a direction opposite to the side from which it was struck. For example, for a right handed golfer, the golf ball will have "right to left" trajectory. The ball flight for a "draw" tends to have less back spin and, therefore, the ball tends to roll further once it lands. Also, "draws" tend to exhibit lower ball flights. These aspects of a "draw" (i.e., less back spin, further roll and lower ball flight) tend to increase the distance that the golf ball will travel upon being struck by the golfer. Therefore, providing the center of gravity of the golf club head body near the heel can increase the distance of a golf shot, which may be particularly useful in "long" irons.

According to some other aspects of this disclosure, the multi-legged bridge members in "short" iron type golf clubs (i.e., irons with a relatively high degree of loft, e.g., a 9-iron, wedges, etc.) may be shaped to provide a center of gravity of the golf club head body which is closer to the toe of the club head body. Such a configuration increases the distance from the hosel to the center of gravity of the golf club head body. Because the center of gravity is further away from the hosel, the golfer may not be able to rotate the golf club head body as quickly or easily (e.g., from an open club face position to a closed club face position). Therefore, the stability of the golf shot may be increased. Hence, such a configuration can aid a golfer in imparting "fade" trajectory to the golf ball. A "fade" is a golf shot in which the golfer curves the ball a direction corresponding to the side from which it was struck. For example, for a right handed golfer, the golf ball will have "left to right" trajectory. The ball flight for a "fade" tends to have more back spin and, therefore, the ball tends to roll less once it lands. Also, "fades" tend to exhibit higher ball flights. These aspects of a "fade" (i.e., more back spin, less roll and higher ball flight) tend to stop the ball from rolling. Therefore, providing the center of gravity of the golf club head body near the toe can aid the golfer in stopping the ball from rolling when it lands on the green, which may be particularly useful in "short" irons.

According to some other aspects of this disclosure, the multi-legged bridge members in "middle" iron type golf clubs (i.e., irons with a relatively intermediate degree of loft, e.g., a 5-iron) may be shaped to provide the center of gravity of the golf club head body generally near the center of the club head body. Such a configuration can create a relatively intermediate distance from the hosel to the center of gravity of the golf club head body. Because the center of gravity is at a relatively intermediate distance from the hosel (e.g., near the center of the golf club head body) the "middle" irons may have some characteristics from each of the above described "long" and "short" irons (e.g., further distance and better ball control), but not to the same extent.

Additional aspects of this disclosure relate to iron-type golf club structures that include golf club heads, e.g., of the types described above. Such iron-type golf club structures further may include one or more of: a shaft member attached to the club head (optionally via a separate hosel member or a hosel member provided as a part of one or more of the club head and/or shaft); a grip or handle member attached to the shaft member; additional weight members; medallions; etc.

Still additional aspects of this disclosure relate to methods for producing iron-type golf club heads and iron-type golf club structures in accordance with examples of this disclosure. Such methods may include, for example, one or more of the following steps in any desired order and/or combinations: (a) providing a golf club head body of the various types described above (including any or all of the various structures, features, and/or arrangements described above), e.g., by manufacturing or otherwise constructing the golf club head body, by obtaining the golf club head body from a third party source, etc.; (b) engaging a shaft member with the golf club head body; and (c) engaging a grip member with the shaft member.

Given the general description of various example aspects of the disclosure provided above, more detailed descriptions of various specific examples of golf clubs and golf club head structures according to the disclosure are provided below.

II. Detailed Description of Example Golf Club Heads, Golf Club Structures, and Methods According to the Disclosure The following discussion and accompanying figures describe various example golf clubs and golf club head structures in accordance with the present disclosure. When the same reference number appears in more than one drawing, that reference number is used consistently in this specification and the drawings to refer to the same or similar parts throughout.

More specific examples and features of iron-type golf club heads and golf club structures according to this disclosure will be described in detail below in conjunction with the example golf club structures illustrated in FIGS. 1-4.

FIG. 1 generally illustrates an example of an iron-type golf club 100 and golf club head body 102 in accordance with the present disclosure. In addition to the golf club head body 102, the overall golf club structure 100 of this example includes a hosel region 104, a shaft member 106 received in and/or inserted into and/or through the hosel region 104, and a grip or handle member (not shown) attached to the shaft member 106. Optionally, if desired, the external hosel region 104 may be eliminated and the shaft member 106 may be directly inserted into and/or otherwise attached to the head member 102 (e.g., through an opening provided in the top of the club head body 102, through an internal hosel member (e.g., provided within an interior chamber defined by the club head body 102), etc.). The hosel member 104 may be integrally formed as part of the club head structure 102, or it may be separately formed and engaged therewith (e.g., by adhesives or cements; by welding, brazing, soldering, or other fusing techniques; by mechanical connectors; etc.). Conventional hosels and their inclusion in an iron type club head structure may be used without departing from this disclosure.

The shaft member 106 may be received in, engaged with, and/or attached to the club head body 102 in any suitable or desired manner, including in conventional manners known and used in the art, without departing from the disclosure. As more specific examples, the shaft member 106 may be engaged with the club head body 102 via a hosel member 104 and/or directly to the club head structure 102, e.g., via adhesives, cements, welding, soldering, mechanical connectors (such as threads, retaining elements, or the like), etc.; through a shaft-receiving sleeve or element extending into the club head body 102; etc. If desired, the shaft 106 may be connected to the head 102 in a releasable manner using mechanical connectors to allow easy interchange of one shaft for another on the head.

The shaft member 106 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle member (not shown) may be attached to, engaged with, and/or extend from the shaft member 106 in any suitable or desired manner, including in conventional manners known and used in the art, e.g., using adhesives or cements; via welding, soldering, brazing, or the like; via mechanical connectors (such as threads, retaining elements, etc.); etc. As another example, if desired, the grip or handle member (not shown) may be integrally formed as a unitary, one-piece construction with the shaft member 106. Additionally, any desired grip or handle member materials may be used without departing from this disclosure, including, for example: rubber materials, leather materials, rubber or other materials including cord or other fabric material embedded therein, polymeric materials, and the like.

The club head body 102 itself also may be constructed in any suitable or desired manner and/or from any suitable or desired materials without departing from this disclosure, including from conventional materials and/or in conventional manners known and used in the art. For example, in the example structure shown in FIG. 1, the club head body 102 includes a ball striking face member 102*a* (including a ball striking face plate 102*b* integrally formed with the face member 102*a* or attached to a frame member such that the face plate 102*b* and frame member together constitute the overall face member 102*a*). The club head body 102 of this illustrated example further includes a top, or crown, portion 102*c* and a sole portion 102*d*. The club head body 102 and/or its various parts may be made by forging, casting, molding, and/or using other techniques and processes, including techniques and processes that are conventional and known in the art.

A wide variety of overall club head constructions are possible without departing from this disclosure. For example, if desired, some or all of the various individual parts of the club head body 102 described above may be made from multiple pieces that are connected together (e.g., by adhesives or cements; by welding, soldering, brazing, or other fusing techniques; by mechanical connectors; etc.). The various parts (e.g., top portion 102*c*, sole portion 102*d*, etc.) may be made from any desired materials and combinations of different materials, including materials that are conventionally known and used in the art, such as metal materials, including lightweight metal materials, composite materials, polymer materials, etc.

The dimensions and/or other characteristics of a golf club head structure 102 according to examples of this disclosure may vary significantly without departing from the disclosure. For example, any iron type club head may be provided including, for example: iron type hybrid clubs, driving irons, 0 through 10 irons, wedges (e.g., pitching wedges, lob wedges, gap wedges, sand wedges, etc.), chipping clubs, etc.

Figure 2A:
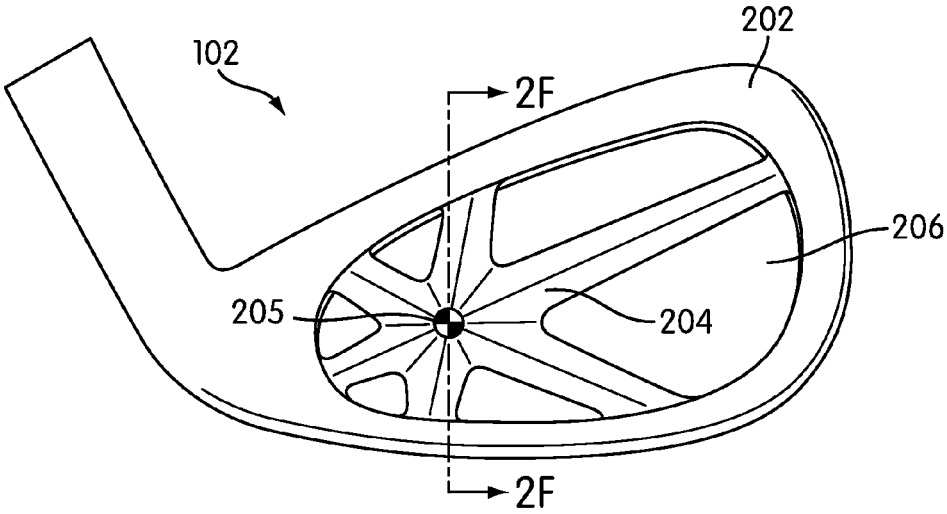
FIGS. 2A-C illustrate golf club head structures according to at least some examples of this disclosure.
Figure 2B:
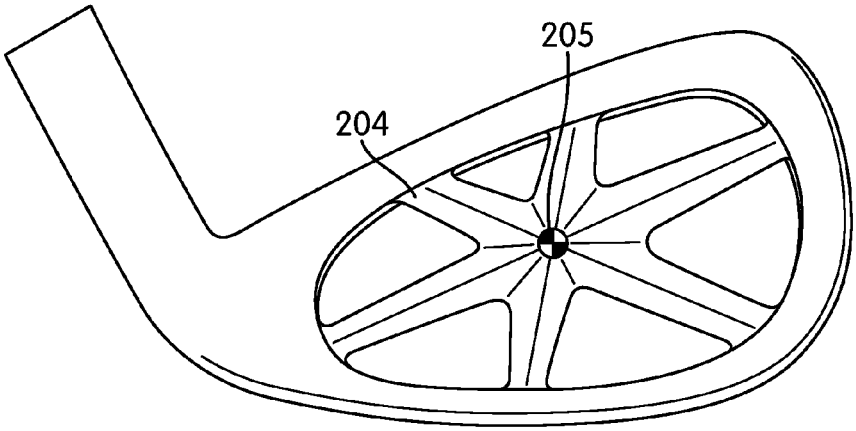
Figure 2C:
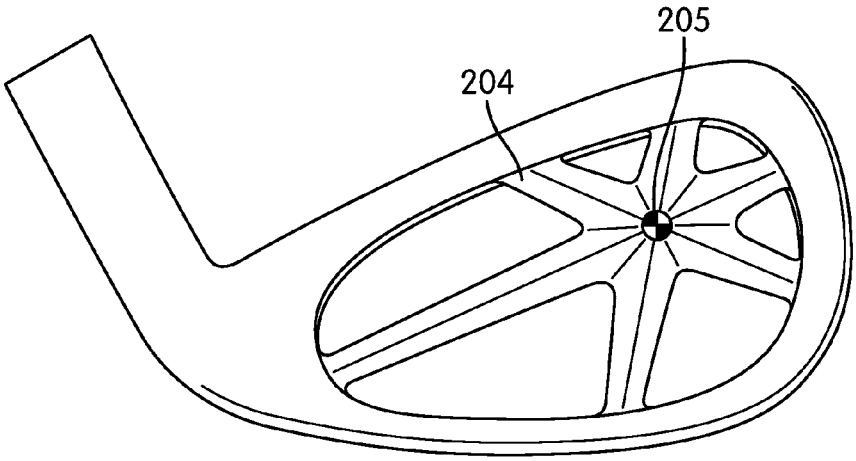
Figure 2D:
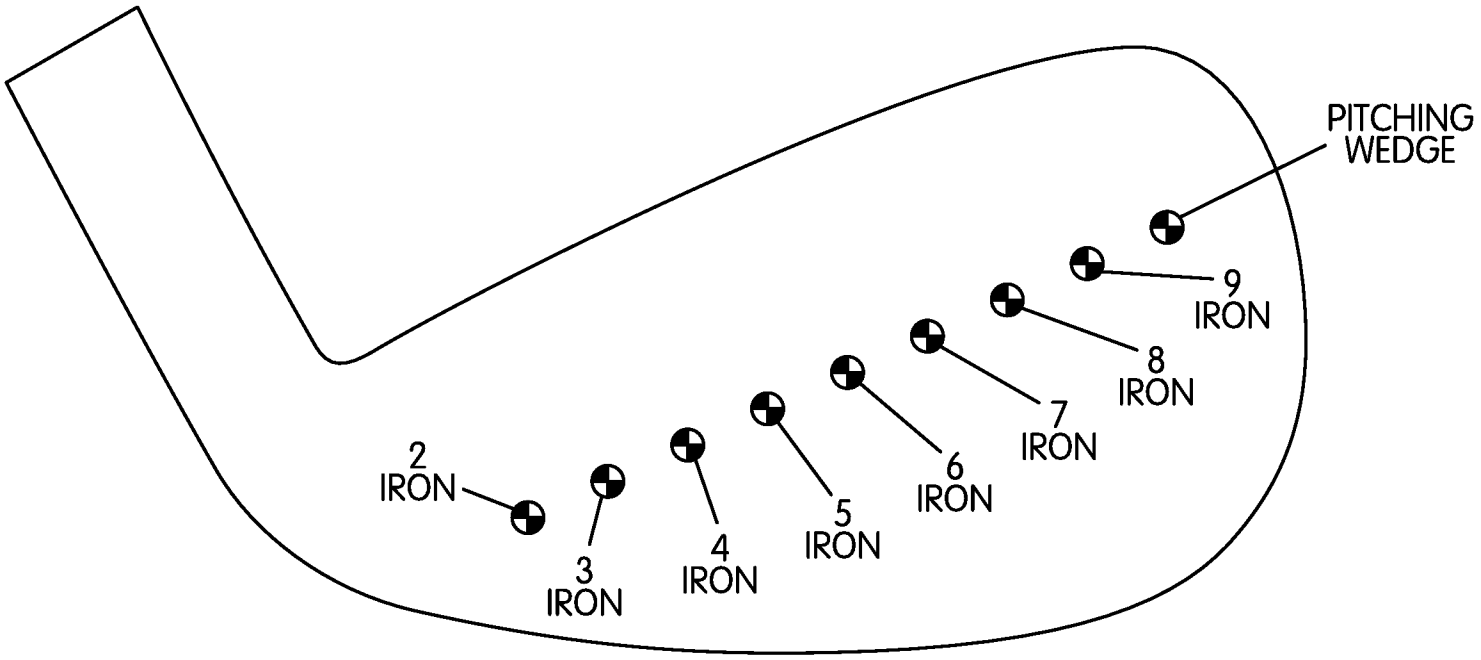
FIG. 2D schematically shows a progression of the centers of multi-legged bridge members of club head bodies in a set of golf clubs according to examples of this disclosure.
Figure 2E:
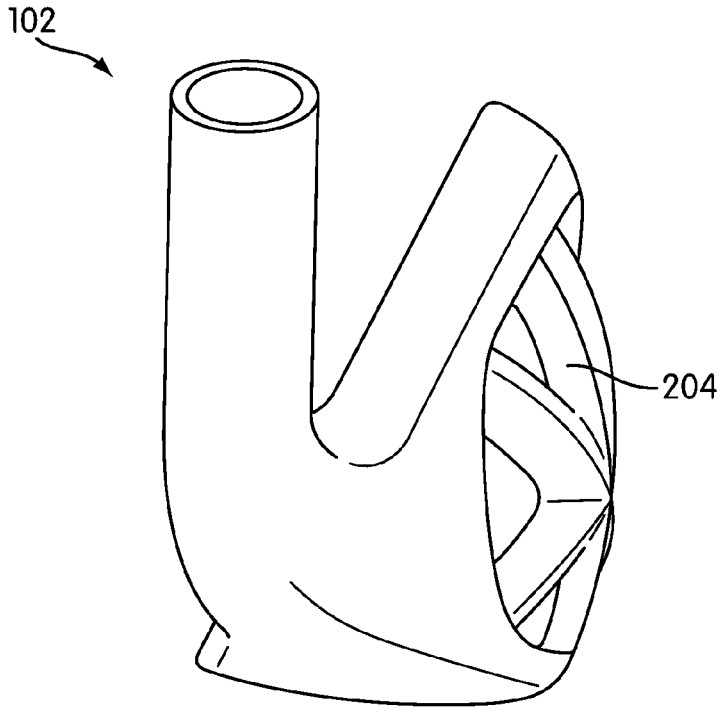
FIG. 2E illustrates a perspective heel end view of golf club head structure according to at least some examples of this disclosure.
Figure 2F:
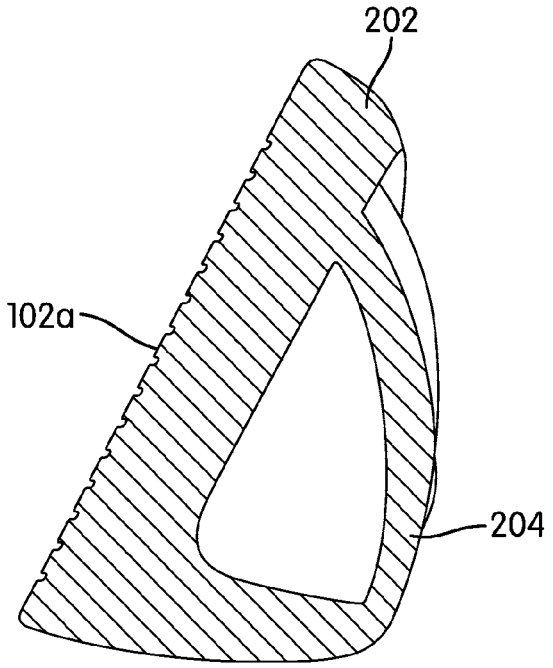
FIG. 2F illustrates a cross sectional view of golf club head structure shown in FIG. 2A.

FIGS. 2A-F illustrate example features and structures that may be included in golf clubs and golf club head bodies in accordance with examples of this disclosure. As seen in FIGS. 2A-C, the golf club head body 102 may include a perimeter weighting member 202. As shown in FIGS. 2E-F, the perimeter weighting member 202 may extend rearwardly from the ball striking face 102*a* and along at least a portion of a circumferential area of the golf club head body 102.

Further, according to aspects of this disclosure, the golf club head body 102 may include a multi-legged bridge member 204 which indicates the golf club head body's center of gravity (denoted symbolically at reference numeral 205). According to some aspects of this disclosure, and as seen in FIGS. 2A-C, the multi-legged bridge member 204 may be either a portion of the perimeter weighting member 202 of the golf club head body 102 or a separate element (e.g., made from the same or different materials as the perimeter weighting member) that is attached to the perimeter weighting member 202. For example, in the first case wherein the multi-legged bridge member 204 is a portion of the perimeter weighting member 202, during manufacture of the golf club head bodies 102, the golf club head bodies including the multi-legged bridge members 204 could be formed (e.g., in a mold). In the second case, wherein the multi-legged bridge member 204 is a separate element that is attached to the golf club head body 102, then during manufacture of the golf club head bodies 102, or, alternatively, after manufacture (e.g., during a club fitting), the multi-legged bridge members 204 could be selectively attached to the club head bodies 102. For example, the multi-legged bridge member 204 could be attached to the club head body in a variety of ways including: via adhesives, cements, welding, soldering, mechanical connectors (such as threads, retaining elements, snap fit, or the like), etc. If desired, the multi-legged bridge member 204 may be attached to the club head body 102 in a releasable manner using mechanical connectors to allow easy interchange of multi-legged bridge member 204 for another. It is noted that in such embodiments a tool may be used to attach and/or release the interchangeable multi-legged bridge member 204 from the club head body 102. In either case, such structures of the multi-legged bridge member 204 may be positioned at least along the top, bottom or side portions of the perimeter weighting member 202 and may form a substantial portion of at least one of the top, bottom or side of the perimeter weighting member 202.

In the depicted embodiment, the multi-legged bridge member 204 extends over a cavity 206 in the rear portion of the club head body 102. Further, as seen in the depicted embodiment, the multi-legged bridge member 204 has a "star" shape with six legs which extend out from the "center" of the "star" (i.e., the point where the legs of the "star" converge) to the perimeter weighting member 202. Hence, as shown, the multi-legged bridge member 204 has six points of contact with the perimeter weighting member 202 and, further, contacts each of the top, bottom and sides of the perimeter weighting member 202. Therefore, as can be seen, the multi-legged bridge member 204 extends from the heel to toe and the crown portion to sole portion of the golf club head body 102. The "center" of the "star" (i.e., the point where the legs converge) is positioned over the golf club head body's center of gravity 205. Further, according to at least some aspects of this disclosure, as the legs extend from the perimeter weighting member 202 towards the "center" of the "star", the legs extend away from the face of the golf club head body 102. In this way, the "center" of the "star" defines an apex of the multi-legged bridge member 204. Hence, in such embodiments, the apex will identify the golf club head body's center of gravity 205.

Therefore, according to some aspects of this disclosure, the "center" of the "star" or the apex of the "star" will indicate the precise location of the golf club head body's center of gravity 205. This allows the golfer to actually see the position of the center of gravity for each golf club body in the set (e.g., during practice). Hence, when the golfer uses the golf club (e.g., during a round), the golfer will know that the center of gravity for each golf club body in the set is correct (i.e., in the correct position). It is understood that when the multi-legged bridge member 204 is connected to the club head body 102, the point at the "center" of the "star" and the center of gravity for the golf club head body 102 are fixed or stationary.

According to some aspects of this disclosure, in a set of golf clubs wherein each golf club head body has a different center of gravity, the multi-legged bridge member 204 for each golf club head body 102 may be different (e.g., a differently shaped element) in order to reflect the different location of the center of gravity of each particular golf club head body in the set. For example, FIGS. 2A-C illustrate golf club head bodies of such a set of golf clubs. FIG. 2A is an illustrative embodiment of a golf club head body 102 for a "long" iron (e.g., a 3-iron), FIG. 2B is an illustrative embodiment of a golf club head body 102 for a "middle" iron (e.g., a 5-iron), and FIG. 2C is an illustrative embodiment of a golf club head body 102 for a "short" iron (e.g., a 9-iron). As can be seen by comparing FIGS. 2A, 2B and 2C, the different golf club head bodies each have a different center of gravity 205 and, further, the multi-legged bridge members 204 are shaped to reflect the respective centers of gravity 205 for the different golf club head bodies. FIG. 2D schematically shows an entire progression of the position of the "centers" or apexes of the multi-legged bridge members 204 in a set of golf clubs according to an illustrative embodiment of this disclosure. It is noted that the schematic rendering shown in FIG. 2D is not to scale and, instead, is used merely to give the reader a sense of the general progression of the center of gravity for one embodiment of this disclosure. As seen in FIG. 2D, the progression begins as a 2-iron (one of the club head bodies with a low degree of loft relative to the set of club head bodies) with the center of gravity 205 located generally towards the lower heel end of the club head body 102. The progression continues from the lower heel towards the upper toe of the club head body 102 until the progression ends as a pitching wedge (one of the club head bodies with a high degree of loft relative to the set of club head bodies) with the center of gravity 205 located generally towards the upper toe end of the club head body 102. In this way, the multi-legged bridge member 204 of each golf club head body reflects the different center of gravity for each particular golf club head body 102 in the set of golf clubs. It is noted of course, that this is merely one illustrative embodiment of a set of golf clubs according to this disclosure and other sets of golf clubs according to this disclosure may include other clubs, such as sand wedges, lob wedges, hybrids irons, etc. Further, it is noted that other desired progressions or arrangements may be provided without departing from this disclosure.

According to some aspects of this disclosure, in addition to merely indicating the location of the center of gravity of the club head body 102, the shape of the multi-legged bridge member 204 can be used to alter (e.g., shift) the center of the gravity of the club head body 102. For example, due to the multi-legged bridge member's weighting characteristics (weight, density, etc.), the shape of the multi-legged bridge member 204 will redistribute the weight of the golf club head body 102 (as compared to the golf club head body without the multi-legged bridge member 204) and thereby shift club head body's center of gravity 205. Therefore, the multi-legged bridge member 204 can be selectively shaped and, if needed, selectively attached to the club head body 102 to control features of the club head's center of gravity 205.

For example, depending on the shape of the multi-legged bridge member 204, the center of gravity of the club head body may be adjusted both vertically and horizontally. For example, relative to the club head body 102 in which the multi-legged bridge member 204 is included, the multi-legged bridge member 204 could be shaped so that the "center" of the "star" is closer to the heel, toe, crown portion, sole portion, etc. of the golf club head body 102. Further, different portions of the multi-legged bridge member 204 can also be varied to affect the center of gravity of the club head body 102. For example, the legs could be: different lengths (e.g., legs on a toe side relative to the "center" of the "star" are longer than legs on a heel side relative to the "center" of the "star"), widened or narrowed, made thicker or thinner, differently tapered (i.e., made relatively wide at one end and comparatively less wide at the other end), symmetrical or asymmetrical (e.g., relative to the "center" of the "star"), etc. in order to achieve the desired center of gravity positioning. Alternatively, or additionally, the "center" of the "star" could be made larger or smaller in diameter, made thicker or thinner, etc.

Further, according to some aspects of this disclosure, the multi-legged bridge member 204 may have a different weight, a different density, a different weight distribution, and/or other different weighting characteristics than the perimeter weighting member 202 (or at least some portions of the perimeter weighting member 202) or other portions of the club head body 102. For example, the multi-legged bridge member 204 may be made heavier as compared to the other parts of the golf club head (e.g., by forming the multi-legged bridge member 204 from a different material than the other parts of the golf club head body 102 or by including a weighted mass, such as lead or tungsten containing material, etc. in the multi-legged bridge member 204). Additionally, different sections or portions of the multi-legged bridge member 204 (e.g., one or more legs, different portions of the same leg, the "center" of the "star", etc.) may have a different weight, a different density, a different weight distribution, and/or other different weighting characteristics (e.g., be made heavier or lighter in a manner such as described above) from each other and/or the perimeter weighting member 202 (or at least some portions of the perimeter weighting member 202) or other portions of the club head body 102.

Yet, according to some other aspects of this disclosure, the multi-legged bridge member 204 may have the same weighting characteristics (weight, density, etc.) as the perimeter weighting member 202 or other portions of the club head body 102. Further, it is noted that, different sections or portions of the perimeter weighting member 202 may also have a different weight, a different density, a different weight distribution, and/or other different weighting characteristics than other sections or portions of the perimeter weighting member 202. For example, the crown portion of the perimeter weighting member 202 may be less dense the sole portion of the perimeter weighting member 202. Regardless of whether the multi-legged bridge member 204 (or a portion thereof) has the same or different weight, density, weight distribution, and/or other weighting characteristics as the perimeter weighting member 202 (or at least portions of the perimeter weighting member 202) or other portions of the club head body 102, the multi-legged bridge member 204 can be still be selectively shaped to control features of the club head's center of gravity 205.

For instance, as mentioned above, FIGS. 2A-C illustrate the different locations of centers of gravity 205 for some differently shaped multi-legged bridge members 204 of the golf club head bodies. In the arrangement shown in FIG. 2A, the shape of the multi-legged bridge member 204 is such that the "center" of the "star" is in the lower heel region of the club head body and, therefore, the legs converge towards the "center" of the "star" in that lower heel region. Hence, the shape of multi-legged bridge member 204 in the depicted embodiment, concentrates mass and weight of the multi-legged bridge member 204 close to the heel. Thus, the center of gravity 205 of this arrangement is closer to the heel of the club head body (e.g., closer to the heel than the toe). In contrast, as shown in FIG. 2C, the shape of the multi-legged bridge member 204 is such that the "center" of the "star" is in the upper toe region of the club head body and, therefore, the legs converge towards the "center" of the "star" in that upper toe region. Hence, the shape of multi-legged bridge member 204 in the depicted embodiment, concentrates mass and weight of the multi-legged bridge member 204 close to the toe. Thus, the center of gravity of this arrangement is closer to the toe of the club head body 102 (e.g., closer to the toe than the heel).

These different locations of the center of gravity 205 of the club head bodies can affect the trajectory and ball flight of a golf ball struck by the golf club. Hence, it is understood that selectively shaping the multi-legged bridge members 204 (e.g., weighted multi-legged bridge members) can produce a set of golf clubs with desirable characteristics. For example, the shape of the multi-legged bridge member in FIG. 2A decreases the distance from the hosel to the center of gravity. Therefore, a "long" iron of such a set of golf clubs has a club head body with a center of gravity near the hosel. Hence, as discussed above, such "long" irons can aid a golfer in imparting a "draw" trajectory to the golf ball and, therefore, provide characteristics of a "draw" shot (i.e., less backspin, further roll and lower ball flight) which will tend to increase the distance that the golf ball will travel upon being struck by the golfer. Conversely, the shape of the multi-legged bridge member in FIG. 2C increases the distance from the hosel to the center of gravity 205. Therefore, a "short" iron of such a set of golf clubs has a club head body with a center of gravity 205 near the toe. Hence, as discussed above, such "short" irons can aid a golfer in imparting "fade" trajectory to the golf ball and, therefore, provide characteristics of a "fade" shot (i.e., more backspin, less roll and higher ball flight) which tend to provide enhanced ball control (e.g., stopping the ball on the green).

As discussed above, the weighting features of golf club heads in accordance with this disclosure are not limited to controlling the horizontal position of the golf club's center of gravity (the horizontal position when the golf club is oriented at a ball addressing position). Rather, the center of gravity in the vertical direction also may be selectively controlled, if desired, in at least some examples of golf club head structures according to this disclosure. Increasing the weight in the crown area of the club head (e.g., by providing more weight in the legs of multi-legged bridge member 204 that are closer to the crown portion), produces a higher center of gravity in the golf club head which can provide a more boring golf ball flight path, e.g., for play in windy conditions, to provide more "running" shots, and/or to help compensate for swing flaws that typically produce an excessively high ballooning flight. Conversely, increasing the weight in the sole area of the club head (e.g., by providing more weight in the legs of the multi-legged bridge member 204 that are closer toward the sole portion), produces a lower center of gravity in the golf club head which can provide a more lofted golf ball flight path, which can help a golfer get the ball in the air.

According to some aspects of this disclosure, the multi-legged bridge member 204 can be shaped so that it extends away from the face of the golf club head body 102. For example, as shown in FIG. 2E the multi-legged bridge member 204 may extends from the heel, toe, sole portion and crown portion of the golf club head body 102 away from the face of the golf club head body 102. FIG. 2F shows a cross-sectional view of such an embodiment wherein the multi-legged bridge member 204 extends from perimeter weighting member 202 (i.e., from the heel, toe, sole portion and crown portion of the golf club head body 102 in the depicted embodiment) away from the face of the golf club head body 102 and does not contact the rear surface of the face of the golf club head body 102. By shaping the multi-legged bridge member 204 to extend away from the face of the golf club head body 102, the center of gravity of the golf club head body 102 can be shifted away from the face of the golf club head body 102. Therefore, the Moment of Inertia (MOI) of the club head body 102 about its center of gravity is increased.

Such an increased MOI can provide more "forgiveness" on "mis-hits" (i.e., shots wherein the golf ball is struck off center of the club head body 102), e.g., by reducing the amount the golf club head body will twist in response to the mis-hit. Another advantage of shaping the multi-legged bridge member 204 to extend away from the face of the golf club head body 102 and, thereby, move more mass and, hence, the center of gravity of the club head body 102 away from the face, is that such a configuration can create a higher ball flight.

As discussed, in such an embodiment wherein the multi-legged bridge member 204 is positioned away from the face of the golf club head body 102, the multi-legged bridge member 204 indicates the center of gravity by the "center" of the "star" or apex of the "star" being positioned at a point in space above the center of gravity of the club head 205. Therefore, when viewed straight on from an angle such as seen in FIGS. 2A-C, the multi-legged bridge member 204 will indicate the center of gravity 205. Of course, according to some other aspects of the disclosure the multi-legged bridge member 204 could be shaped so that it extends straight across the cavity 206 without creating an apex, or the multi-legged bridge member 204 could even be angled towards the rear surface of the club head body 102.

Therefore, it can be seen that selectively shaping the multi-legged bridge member 204 affects the center of gravity of the golf club head. In this way, when the multi-legged bridge member 204 is shaped in a particular fashion, the multi-legged bridge member 204 alters the weight distribution of the golf club head body 102 to move the club head body's center of gravity 205 to a desired position. Additionally, it can be seen that according to aspects of this disclosure, the multi-legged bridge member 204 can both indicate the precise position of the center of gravity of the golf club head body and, also, if desired, be selectively shaped and, if needed, selectively attached to the club head body 102 to shift the weight of the golf club head body 102 in order to move the club head body's center of gravity 205 to a desired position.

Further, it is noted that while the depicted embodiment shown schematically in FIG. 2D demonstrates one progression according to one embodiment of this disclosure, this is not to suggest that other progressions or variations are not contemplated within the scope of this disclosure, In fact, other desired progressions or arrangements may be provided without departing from this disclosure. For example, during a club fitting, the multi-legged bridge members 204 could be selectively attached to the club head bodies 102 in a different manner (e.g., from the toe in "long" irons to the heel in "short" irons) to better conform to a particular golfer's swing or tendencies. For example, during a club fitting, in order to analyze a particular golfer's swing, tendencies, characteristics, etc., a club fitter could use a variety of techniques including: observation with the naked eye of either the swing and/or the golfer's body throughout the swing; recording and play back (e.g., in slow motion or real time) of the swing and/or the golfer's body throughout the swing; measurement of particular aspects of the swing including: the angle of the club head and/or the shaft throughout the swing (e.g., at the take away, during the downswing, at impact, during the follow through, etc.), velocity or acceleration of the club head throughout the swing, etc.; computer analysis of the swing, such as computer analysis of the above mentioned measurements and recordings; etc. Upon analyzing the particular golfer's swing or tendencies (e.g., in a manner described above), a club fitter could selectively attach the multi-legged bridge members 204 to the club head bodies 102 based on the analysis of at least one characteristic of a golfer's swing in a manner to better aid a particular golfer achieve a desired result. In some cases, club head bodies may include multi-legged bridge members 204 that are interchangeable as described above. Therefore, the club fitter may exchange or replace the existing interchangeable multi-legged bridge members 204 with other interchangeable multi-legged bridge members 204 in order to better aid a particular golfer achieve a desired result. For example, if a golfer has a tendency to "slice", then the club fitter may employ interchangeable multi-legged bridge members 204 that provide more mass in the heel. Conversely, if a golfer has a tendency to "hook" the golf ball, then the club fitter may employ interchangeable multi-legged bridge members 204 that provide more mass in the toe.

Of course the multi-legged bridge member need not be shaped like a "star" and, instead, other embodiments of the multi-legged bridge member could be employed. In fact, the multi-legged bridge member may take on a wide variety of forms without departing from the spirit of disclosure. For example, according to some aspects of this disclosure, instead of a "star" shape, a "spider" or "windmill" shaped multi-legged bridge member could be used.

Figure 3A:
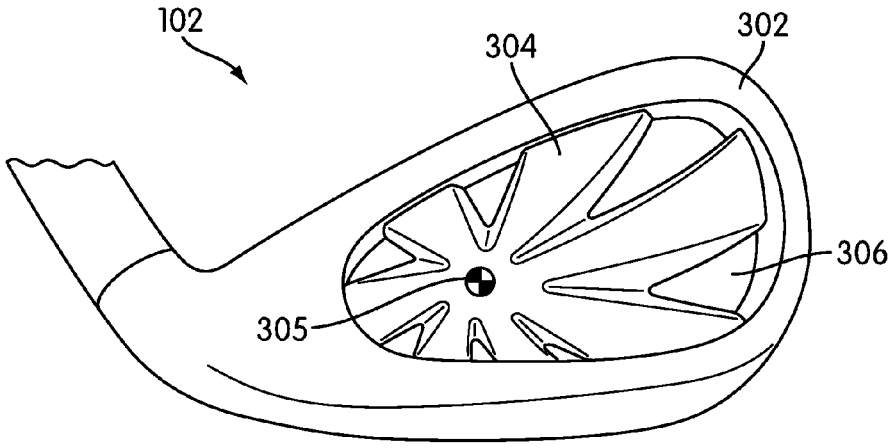
FIGS. 3A-3C illustrate golf club head structures according to at least some examples of this disclosure.
Figure 3B:
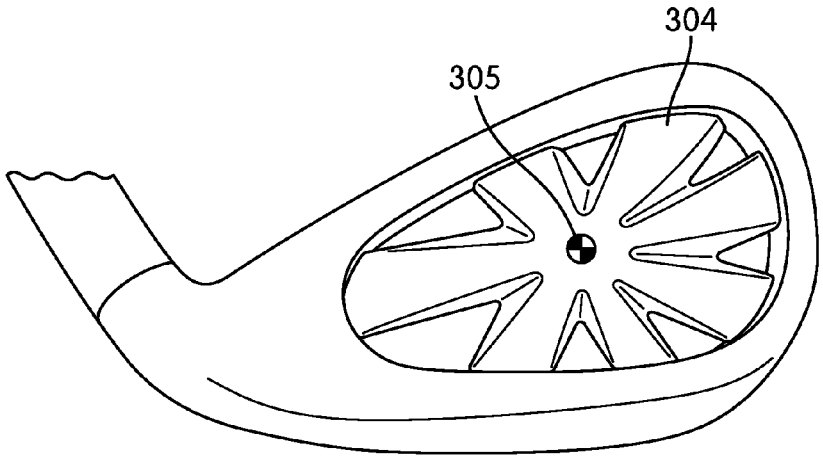
Figure 3C:
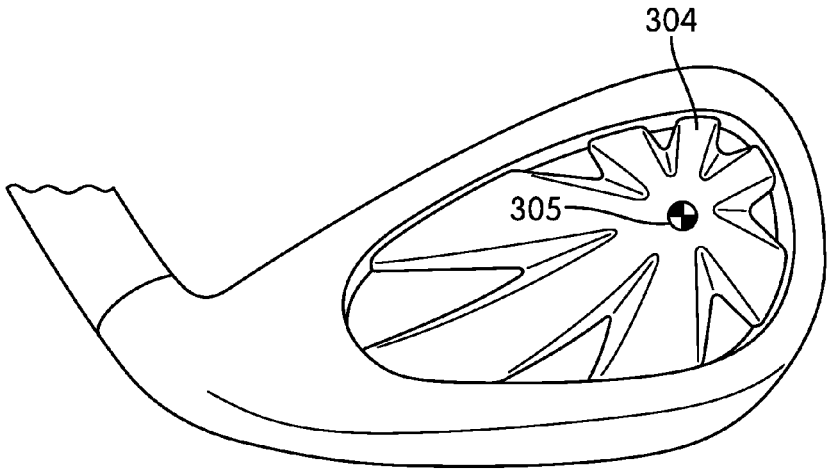

FIGS. 3A-C illustrate such example structures that may be included in golf clubs and golf club head bodies in accordance with this disclosure. As seen in FIGS. 3A-C, each golf club head body 102 includes a perimeter weighting member 302 (similar to the perimeter weighting member described above) and a multi-legged bridge member indicator 304. The embodiment shown in FIGS. 3A-C is similar to the embodiment described above and, therefore, for the sake of brevity will not be repeated here. However, it is noted that at least one of the legs of the multi-legged bridge member indicator 304 exhibits a curved shape which resembles a "spider leg" or a "windmill blade." According to some aspects of this disclosure, the curvature of the legs may be uniform throughout the multi-legged bridge member 304 or, alternatively, some or all of the legs could have varying degrees of curvature.

Further, as discussed above in regard to the previously described embodiment, according to some aspects of this disclosure, in a set of golf clubs wherein each golf club head body has a different center of gravity, the multi-legged bridge member 304 for each golf club head body 102 may be different (e.g., a differently shaped element) in order to reflect the different location of the center of gravity of each particular golf club head body in the set. FIGS. 3A-C illustrate golf club head bodies of such a set of golf clubs. FIG. 3A is an illustrative embodiment of a golf club head body 102 for a "long" iron (e.g., a 3-iron), FIG. 3B is an illustrative embodiment of a golf club head body 102 for a "middle" iron (e.g., a 5-iron), and FIG. 3C is an illustrative embodiment of a golf club head body 102 for a "short" iron (e.g., a 9-iron). As can be seen by comparing FIGS. 3A, 3B and 3C, the different golf club head bodies each have a different center of gravity 305 and, further, the multi-legged bridge members 304 are shaped to reflect the respective centers of gravity 305 for the different golf club head bodies.

As seen by comparing FIGS. 3A, 3B and 3C, according to the depicted embodiment, the progression of center of gravity 305 of the club head body 102 moves generally successively from the lower heel in "long" irons to the upper toe in "short" irons. In this way, the apex or the "center" of the "spider"/"windmill" shape of the multi-legged bridge member 304 of each golf club head body 102 reflects the different center of gravity for each particular golf club head body 102. However, as mentioned above with regard to the previously described embodiment, this is merely one embodiment of the disclosure and other desired progressions of the multi-legged bridge members 304 may be provided without departing from this disclosure (e.g., the multi-legged bridge members 304 could shift in an opposite direction (i.e., from the toe end in "long" irons to the heel end in "short" irons)). Therefore, it is realized that the multi-legged bridge members 304 may be positioned or arranged in or around the golf club head bodies of a set of golf clubs in a variety of different manners, orientations, and the like without departing from this disclosure.

Further, as discussed above in regard to the previously described embodiment, according to some aspects of this disclosure, in addition to merely indicating the location of the center of gravity of the club head body 102, the shape of the multi-legged bridge member 304 can be used to alter (e.g., shift) the center of the gravity of the club head body 102. For example, due to weighting characteristics (weight, density, etc.) of the multi-legged bridge member, the shape of the multi-legged bridge member 304 will redistribute the weight of the golf club head body 102 (as compared to the golf club head body without the multi-legged bridge member indicator 304) and thereby shift the club head body's center of gravity 305. Therefore, the multi-legged bridge member 304 can be selectively shaped to control features of the club head's center of gravity 305.

While the above described embodiments relate to sets of the golf clubs wherein the multi-legged bridge members are generally of the same type (e.g., "star-shaped", "spider-shaped", etc.), this is not to suggest that the same types of multi-legged bridge members must be used within the same set. In other words, the multi-legged bridge members used throughout the set do not necessarily have to be uniform in the type. In fact, according to some aspects of this disclosure, different types of multi-legged bridge members are used within the same set.

Figure 4A:
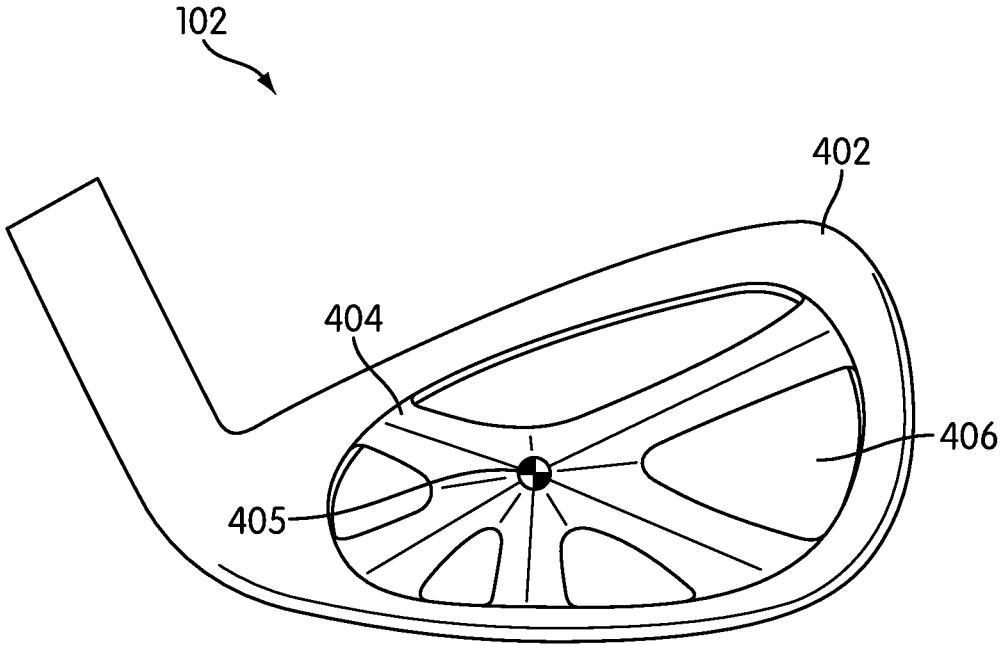
FIGS. 4A and 4B illustrate golf club head structures according to at least some examples of this disclosure.
Figure 4B:
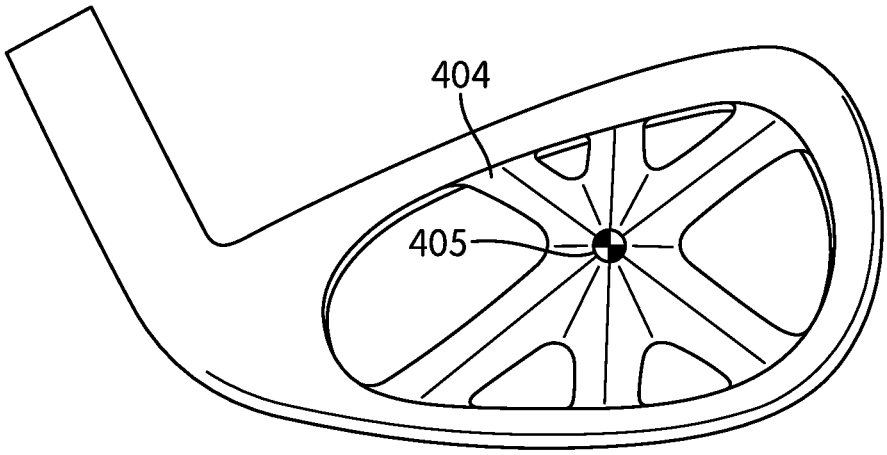

FIGS. 4A and 4B illustrate such example structures of multi-legged bridge members 404 that may be included in the golf club head bodies 102 of a set of golf clubs in accordance with this disclosure. The embodiments shown in FIGS. 4A and 4B are embodiments similar in most respects to the embodiments described above and, therefore, for the sake of brevity will not be repeated here. However, in contrast to the above described embodiments, in a set of golf clubs according to this illustrative embodiment, the number of points of contact that the multi-legged bridge member 404 has with the golf club head body 102 varies in regard to the particular club head body.

For example, FIG. 4A is an illustrative embodiment of a golf club head body 102 for a "long" iron (e.g., a 3-iron) and FIG. 4B is an illustrative embodiment of a golf club head body 102 for a "short" iron (e.g., a 9-iron). As can be seen by comparing FIGS. 4A and 4B, the multi-legged bridge member 404 shown in the long iron, FIG. 4A, has five points of the contact with the golf club head body 102, while the multi-legged bridge member shown in the short iron, FIG. 4B, has six points of contact with the golf club head body 102. Such a change in the points of the contact with the golf club head body allows a user to quickly distinguish between different types of clubs (e.g., five legs in "long" irons as opposed to six legs in "short" irons). Further, according to aspects of this disclosure, the same concept is used to distinguish between individual club head bodies rather than different types of club head bodies. In other words, each individual club head body could have a different number of points of contact than the other club head bodies in the set. Similarly, other differences between types of club head bodies or individual club head bodies could be used also. For example, the "star" shape of the multi-legged bridge member 204 could be used for "long" irons, while the "spider" shape of the multi-legged bridge member 304 could be used for "short" irons.

Further, as discussed above in regard to the previously described illustrative embodiments, according to some aspects of this disclosure, in a set of golf clubs wherein each golf club head body has a different center of gravity, the multi-legged bridge member 404 for each golf club head body 102 may be different (e.g., a differently shaped element) in order to reflect the different location of the center of gravity of each particular golf club head body in the set. As can be seen by comparing FIGS. 4A and 4B, the different golf club head bodies 102 each have a different center of gravity 405 and, further, the multi-legged bridge members 404 are positioned to reflect the respective centers of gravity 405 for the different golf club head bodies 102. As seen by comparing FIGS. 4A and 4B, according to the depicted embodiment, the progression of the center of gravity 405 of the club head body 102 moves generally successively from the lower heel in "long" irons to the upper toe in "short" irons. However, as mentioned above with regard to the previously described illustrative embodiments, this is merely one illustrative embodiment of the disclosure and other desired progressions of the multi-legged bridge member 404 may be provided without departing from this disclosure. Therefore, it is realized that the multi-legged bridge members 404 may be positioned or arranged in or around the golf club head bodies of a set of golf clubs in a variety of different manners, orientations, and the like without departing from this disclosure. Further, it is realized that in a set of golf clubs according to example embodiments of this disclosure, in addition to differentiating between different types of the club head bodies 102, the multi-legged bridge members 404 also indicate the precise position of the center of gravity of each particular golf club head body in the set.

Further, as discussed above in regard to the previously described embodiments, according to some aspects of this disclosure, in addition to merely indicating the location of the center of gravity 405 of the club head body 102, the shape of the multi-legged bridge member 404 can be used to alter (e.g., shift) the center of the gravity of the club head body 102. For example, due to weighting characteristics (weight, density, etc.) of the multi-legged bridge member indicator 404, the shape of the multi-legged bridge member 404 will redistribute the weight of the golf club head body 102 (as compared to the golf club head body without the multi-legged bridge member 404) and thereby shift the center of gravity 405 of the club head body 102. Therefore, the multi-legged bridge member indicator 404 can be selectively shaped to control features of the center of gravity 405 of the club head body 102. Hence, in a set of golf clubs according to an illustrative embodiment of this disclosure, in addition to both differentiating between different types of the club head bodies, and indicating the precise position of the center of gravity of each particular golf club head body in the set, the multi-legged bridge members 404 can also, if desired, be selectively shaped to shift the weight of the golf club head body 102 in order to move the club head body's center of gravity 405 to a desired position.

Any type of iron type golf club head structure may include multi-legged bridge member of the types described above (e.g., 204, 304, 404, etc.), including, for example: iron type hybrid clubs, driving irons, 0-10 irons, wedges (e.g., iron type clubs having lofts from 44-68 degrees, such as pitching wedges, lob wedges, sand wedges, gap wedges, etc.), chipping clubs, etc. If desired, in accordance with at least some examples of this disclosure, golf clubs and/or golf club heads in accordance with examples of this disclosure may be sold or marketed as a set including plural irons, including, for example, sets having two or more of iron type hybrid clubs, driving irons, 0-10 irons, pitching wedges, lob wedges, sand wedges, gap wedges, and/or chipping clubs. When present in a set, any desired number of the clubs in the set may have a club head with a multi-legged bridge member in accordance with this disclosure. In some more specific examples, sets of golf clubs in accordance with this disclosure may contain at least the 3-9 irons and a pitching wedge, wherein at least 2 of these irons (and in some examples, all of these irons) will have a club head with a multi-legged bridge member in accordance with examples of this disclosure. As another example, sets of golf clubs in accordance with this disclosure will contain at least the 4-9 irons (or even 5-9 irons or 6-9 irons) and a pitching wedge, and optionally a sand wedge and/or one or more iron type hybrid clubs, wherein at least 2 of these clubs (and in some examples, all of these clubs) will have a club head with a multi-legged bridge member in accordance with examples of this disclosure.

Iron type golf club heads including multi-legged bridge members in accordance with examples of this disclosure are not limited for use with perimeter weighted and/or cavity back type clubs of the types illustrated in FIGS. 1-4. Rather, if desired, multi-legged bridge members may be provided (e.g., in similar positions and/or arrangements) in blade type iron clubs or other iron type golf club head structures without departing from this disclosure. Rather than forming a portion of a perimeter weight member, in blade type clubs, the multi-legged bridge members may be located in at least one of the upper rear portion of the back side of the club, the lower rear portion of the rear portion of the back side of the club, the club sole, etc.

Further, it is noted that while the multi-legged bridge member indicators have been discussed above as indicating the center of gravity of a golf club head body, the multi-legged bridge member indicators could indicate other features of the golf club head (e.g., "sweet spot", etc.) as well.

Finally, it is noted that the specific multi-legged bridge members discussed in detail above are merely examples of multi-legged bridge members that may be used in accordance with this disclosure and are not meant to constitute an exhaustive list. On the contrary, these illustrative examples are simply intended to provide the reader with a better understanding of the disclosure.

For example, according to some aspects of this disclosure, the multi-legged bridge member includes an opening at the "center" or apex of the multi-legged bridge member. The opening at the "center" or apex indicates the club head body's center of gravity. According to some aspects of this disclosure, the rear surface (e.g., the back of face of the golf club head body 102) may exhibit a color in order to help golfer more easily see the center of gravity via the color through the opening. For example, the back of face of the golf club head body 102 may be painted a bright color (e.g., red, yellow, orange, etc.). Alternatively, a colored dot on the apex or "center" could be used to more readily indicate the center of gravity of the club head body. Further, according to other aspects of this disclosure, the multi-legged bridge member may be a several pieces rather than a single unit. Overall, it is understood that while there are many ways in which the multi-legged bridge member could be formed to indicate the respective location of the club head body's center of gravity, as long as the multi-legged bridge member reflects the location center of gravity of a particular golf club head body, it is considered within the scope of the disclosure.

III. Conclusion

The present disclosure is described above and in the accompanying drawings with reference to a variety of example structures, features, elements, and combinations of structures, features, and elements. The purpose served by the disclosure, however, is to provide examples of the various features and concepts related to the disclosure, not to limit the scope of the disclosure. One skilled in the relevant art will recognize that numerous variations and modifications may be made to the embodiments described above without departing from the scope of the present disclosure, as defined by the appended claims. For example, the various features and concepts described above in conjunction with FIGS. 1 through 4 may be used individually and/or in any combination or subcombination without departing from this disclosure.

I claim:

1. A set of iron type golf clubs having variable loft comprising at least two iron type golf clubs with golf club head bodies wherein each of the golf club head bodies has a different center of gravity and includes a multi-legged bridge member on a rear side of the golf club head body, each multi-legged bridge member having a plurality of legs, comprising three or more legs, that extend over a cavity in the rear side of the golf club head body and converge to a point positioned over the cavity and rearwardly away from a portion of the rear side of the golf club head body located within the cavity such that a space is defined between the portion of the rear side of the golf club head body and the point, wherein the point indicates a precise location of the particular center of gravity of the respective golf club head body, wherein the point and the center of gravity of each golf club head body are stationary, and wherein at least two of the legs of the multi-legged bridge member extend away from the point positioned over the cavity in oblique directions relative to each other, wherein each of the golf club head bodies has the point positioned over the cavity in a different location relative to a perimeter weighting member in the rear side of the respective golf club head body;

wherein the plurality of legs of each multi-legged bridge member have different lengths relative to the plurality of legs of each other multi-legged bridge member, whereby the difference in lengths creates the different locations of the points positioned over the cavities of the golf club head bodies.

2. A set of iron type golf clubs according to claim 1, wherein the club head bodies include a hosel and a heel proximate the hosel, and the club head body with a lowest degree of loft relative to the set of club head bodies has a center of gravity closer to the hosel than the toe.

3. A set of iron type golf clubs according to claim 2, wherein the club head body with a highest degree of loft relative to the set of club head bodies have a center of gravity closer to the toe than the heel.

4. A set of iron type golf clubs according to claim 3, wherein the club head body with the lowest degree of loft relative to the set of club head bodies has the center of gravity in a lower portion of the heel.

5. A set of iron type golf clubs according to claim 4, wherein the club head body with the highest degree of loft relative to the set of club head bodies has the center of gravity in an upper portion of the toe.

6. A set of iron type golf clubs according to claim 1, wherein the shape of the multi-legged bridge members changes successively throughout the set of the golf clubs.

7. A set of iron type golf clubs according to claim 6, wherein the shape of the multi-legged bridge members changes successively, such that a center of gravity of the club head body having a lowest degree of loft relative to the set of club head bodies is located in a position closest to a lower heel portion, and the center of gravity of the club head body having a highest degree of loft relative to the set of club head bodies is located in a position closest to an upper toe portion, and wherein locations of the centers of gravity of other club head bodies progress from the lower heel portion to the upper toe portion as a degree of loft of each of the club heads increases.

8. A set of iron type golf clubs according to claim 1, wherein at least a first golf club head body has a first number of points of contact between a multi-legged bridge member and its respective golf club head and at least a second golf club head body has a second number of points of contact between a multi-legged bridge member and its respective golf club head, wherein the first number and the second number are different.

9. A set of iron type golf clubs according to claim 1, wherein the club head body with a lowest degree of loft relative to the set of club head bodies has a fewer number of points of contact between a multi-legged bridge member and its respective golf club head than the club head body with a highest degree of loft relative to the set of club head bodies.

10. A set of iron type golf clubs according to claim 9, wherein the club head body with the lowest degree of loft relative to the set of club head bodies has five or fewer points of contact between the multi-legged bridge member and its respective golf club head body and the club head body with the highest degree of loft relative to the set of club head bodies has six or more points of contact between the multi-legged bridge member and its respective golf club head body.

11. A set of iron type golf clubs according to claim 1, wherein the club head bodies include a toe, a heel, a crown portion, and a sole portion, wherein at least one leg of the multi-legged bridge member extends from the point where the legs converge towards the heel and at least one leg of the multi-legged bridge member extends from the point where the legs converge towards the sole portion.

12. A set of iron type golf clubs according to claim 11, wherein at least one leg of the multi-legged bridge member extends from the point where the legs converge towards the toe.

13. A set of iron type golf clubs according to claim 11, wherein at least one leg of the multi-legged bridge member extends from the point where the legs converge towards the crown portion.

14. A set of iron type golf clubs according to claim 12, wherein at least one leg of the multi-legged bridge member extends from the point where the legs converge towards the crown portion.

15. A set of iron type golf clubs according to claim 1, wherein the club head bodies include a toe, a heel, a crown portion, and a sole portion, wherein at least one leg of the multi-legged bridge member extends from the point where the legs converge towards the heel and at least one leg of the multi-legged bridge member extends from the point where the legs converge towards the crown portion.

16. A set of iron type golf clubs according to claim 15, wherein at least one leg of the multi-legged bridge member extends from the point where the legs converge towards the toe.

17. A set of iron type golf clubs according to claim 15, wherein at least one leg of the multi-legged bridge member extends from the point where the legs converge towards the sole portion.

18. A set of iron type golf clubs according to claim 1, wherein the club head bodies include a toe, a heel, a crown portion, and a sole portion, wherein at least one leg of the multi-legged bridge member extends from the point where the legs converge towards the toe and at least one leg of the multi-legged bridge member extends from the point where the legs converge towards the sole portion.

19. A set of iron type golf clubs according to claim 18, wherein at least one leg of the multi-legged bridge member extends from the point where the legs converge towards the crown portion.

20. A set of iron type golf clubs according to claim 1, wherein the club head bodies include a toe, a heel, a crown portion, and a sole portion, wherein at least one leg of the multi-legged bridge member extends from the point where the legs converge towards the toe and at least one leg of the multi-legged bridge member extends from the point where the legs converge towards the crown portion.

21. A set of iron type golf clubs according to claim 1, wherein as the legs extend towards the point, the legs extend away from the face of the golf club head body.

22. A set of iron type golf clubs according to claim 1, wherein at least two of the legs of each multi-legged bridge member extend away from the point in oblique directions relative to each other.

23. A set of iron type golf clubs according to claim 1, wherein each of the legs of the multi-legged bridge member has a first portion connected to the rear side of the golf club head body and a second portion that extends away from the rear side of the golf club head body over the cavity and is spaced away from the portion of the rear side of the golf club head body located within the cavity.

24. A set of iron type golf clubs according to claim 23, wherein the first portion of each of the legs is connected to the perimeter weighting member.

25. A set of iron type golf clubs according to claim 23, wherein the second portion of each of the legs extends rearwardly away from the rear side of the golf club head body.

26. A set of iron type golf clubs according to claim 1, wherein at least a first golf club head body has a first number of legs of the multi-legged bridge member, and at least a second golf club head body has a second number of legs of the multi-legged bridge member, wherein the first number and the second number are different.

27. A set of iron type golf clubs comprising:

a first iron type golf club with a first golf club head body having a first striking face, a first rear side opposite the first striking face, a first heel, a first toe, a first perimeter weighting member in the first rear side, and a first multi-legged bridge member positioned on the first rear side, the first multi-legged bridge member having a plurality of first legs, comprising three or more legs, that extend over a cavity in the rear side of the golf club head body and converge to a first point positioned over the cavity and rearwardly away from a portion of the first rear side of the first golf club head body located within the cavity such that a space is defined between the portion of the first rear side of the first golf club head body and the first point, wherein the first point indicates a precise location of a first center of gravity of the first golf club head body, wherein the first point and the first center of gravity of the first golf club head body are stationary, and wherein at least two of the first legs of the first multi-legged bridge member extend away from the first point positioned over the cavity in oblique directions relative to each other, a second iron type golf club with a second golf club head body having a second striking face, a second rear side opposite the second striking face, a second heel, a second toe, a second perimeter weighting member in the second rear side, and a second multi-legged bridge member positioned on the second rear side, the second multi-legged bridge member having a plurality of second legs, comprising three or more legs, that extend over a cavity in the rear side of the golf club head body and converge to a second point positioned over the cavity and rearwardly away from a portion of the second rear side of the second golf club head body located within the cavity such that a space is defined between the portion of the second rear side of the second golf club head body and the second point, wherein the second point indicates a precise location of a second center of gravity of the second golf club head body, wherein the second point and the second center of gravity of the second golf club head body are stationary, and wherein at least two of the second legs of the second multi-legged bridge member extend away from the second point positioned over the cavity in oblique directions relative to each other, wherein the first center of gravity and the first point positioned over the cavity are positioned in a first location on the first golf club head body, and the second center of gravity and the second point positioned over the cavity are positioned in a second location on the second golf club head body, wherein the first location is different relative to the first perimeter weighting member than the second location relative to the second perimeter weighting member, and wherein at least one of the first legs of the first multi-legged bridge member has a first length relative to the first perimeter weighting member, and at least one of the second legs of the second multi-legged bridge member has a second length relative to the second perimeter weighting member, wherein the first length is different than the second length, whereby the difference in the first length and second length creates the difference between the first location and the second location.

28. A set of iron type golf clubs according to claim 27, wherein each of the first legs of the first multi-legged bridge member has a first portion connected to the first rear side of the first golf club head body and a second portion that extends away from the first rear side of the first golf club head body over the cavity and is spaced away from the portion of the first rear side of the first golf club head body located within the cavity.

29. A set of iron type golf clubs according to claim 28, wherein the first portion of each of the first legs is connected to the first perimeter weighting member.

30. A set of iron type golf clubs according to claim 28, wherein the second portion of each of the first legs extends rearwardly away from the first rear side of the first golf club head body.

31. A set of iron type golf clubs according to claim 27, wherein the first multi-legged bridge member has a first number of legs, and the second multi-legged bridge member has a second number of legs, wherein the first number and the second number are different.

* * * * *